United States Patent [19]

Fujiura et al.

[11] Patent Number: 4,961,711

[45] Date of Patent: Oct. 9, 1990

[54] ELECTRICAL CONNECTOR

[75] Inventors: Yoshitsugu Fujiura, Tokyo; Shigeru Ishikawa, Hachioji; Hiromitsu Kodama, Yokohama, all of Japan

[73] Assignee: AMP Incorporated, Harrisburg, Pa.

[21] Appl. No.: 366,062

[22] Filed: Jun. 14, 1989

[30] Foreign Application Priority Data

Jul. 15, 1988 [JP] Japan ..... 63-176324

[51] Int. Cl.[5] ..... H01R 13/62

[52] U.S. Cl. ..... 439/357; 439/610

[58] Field of Search ..... 439/350, 351, 357, 358, 439/352, 347, 345, 372, 354, 607, 610

[56] References Cited

U.S. PATENT DOCUMENTS

| | | | |
|---|---|---|---|
| 3,329,925 | 7/1967 | Johnson et al. | 439/357 |
| 4,621,885 | 11/1986 | Szczesny et al. | 439/357 |
| 4,735,583 | 4/1988 | Rudy, Jr. et al. | 439/355 |
| 4,762,505 | 8/1988 | Asich et al. | 439/347 |
| 4,838,808 | 6/1989 | Fujiura | 439/357 |
| 4,838,810 | 6/1989 | Yoshimura | 439/358 |
| 4,842,542 | 6/1989 | Davis | 439/357 |

FOREIGN PATENT DOCUMENTS

| | | | |
|---|---|---|---|
| 2708998 | 9/1978 | Fed. Rep. of Germany | 439/357 |

*Primary Examiner*—William Briggs

*Attorney, Agent, or Firm*—Adrian J. LaRue

[57] ABSTRACT

A shielded electrical connector for matable and latchable connection with a complementary electrical connector (50) comprises an electrical contact assembly (27) covered by a metal shield member (11) having a profiled mating section (31) for matable engagement with a profiled mating section (52) of the complementary connector (50); latch members (20*a*, 20*b*) having slots (24) with sections (24') of the slots (24) having mounting sections (13') of L-shaped mounting members (13) of the shield members (11) disposed therein pivotally mounting the latch members on (20*a*, 20*b*) the shield member, and maintaining sections (13'') of the mounting members (13) along with cantilever members (25) of the latch members (20, 20*b*) maintaining the latch members on the mounting members (11), and spring members (26) of the latch members (20*a*,20*b*) engaging the shield member (11) maintaining hook members (23) of the latch members (20*a*, 20*b*) in latching engagement with latching hooks (53) of the complementary connector (50).

6 Claims, 6 Drawing Sheets

ELECTRICAL CONNECTOR

FIELD OF THE INVENTION

The present invention relates to an electrical connector and more particularly to a shielded electrical connector having movable latch members for latchable engagement with stationary latch members of a complimentary electrical connector for maintaining the shielded electrical connector in electrical connection with the complementary electrical connector.

BACKGROUND OF THE INVENTION

Shielded electrical connectors are known that are electrically connected to the electrical conductors and shield of an electrical cable and have movable latch members for latchable engagement with stationary latch members of a complementary electrical connector.

The latch members of one of these known connectors are in the form of metal members each having latching sections at one end and a dielectric pressing member secured to the other end with a pin-receiving section located between the ends in which a pivot pin is disposed. The pivot pins have their ends secured to the sides of a shield member thereby hingedly mounting the latch members onto the shield member. A dielectric cover member is positioned over the shield member and has openings in the sides through which the dielectric pressing members extend and the latching sections are disposed between the shield member and cover member and are moved away from the shield member sides when the pressing members are pressed inwardly against the bias of spring sections.

The assembly of the latch members onto the shield member via the pivot pins is complicated and resulted in high production costs.

The latch members of another known connector disclosed in Japanese Publication No. 63-155572 published June 28, 1988 comprise metal members having rear sections forcefully fitted into integral arms that extend along the sides of a dielectric cover member that covers a metal shield member, latching sections at the front ends of the metal members that extend along the sides of the shield member between the shield member and the cover member, and spring members as part of the rear sections that engage the sides of the shield member and bias the latching sections against the sides of the shield member. Pressing on the arms moves the latching sections away from the sides of the shield member, the integral arms forming a pivot with the cover member.

The structure of the dielectric cover member with the integral arms is complex, the pivot areas of the arms to the cover member proved to be weak and the production costs were high.

The dielectric cover member and the dielectric covered pressing sections of the latch members prevent static electricity from the bodies of operators to be transferred to the shielded connectors.

An object of the present invention is to provide a shielded electrical connector that is easy to assemble thereby reducing production costs and the latch members operate reliably and stably.

SUMMARY OF THE INVENTION

According to the present invention, a shielded electrical connector comprises an electrical contact assembly including a dielectric housing in which electrical contacts are secured for electrical connection to electrical conductors of a shielded electrical cable; a metal shield member covering the contact assembly and electrical contact connections and for electrically connecting with the shield of the cable; a dielectric covering member covering the shield member; latch members having front sections extending along respective sides of the shield member toward a front end of the shield member and having latching members or hooks at the ends thereof, rear sections having dielectric pressing members thereon extending along the respective sides of the shield member toward a rear end of the shield member with the pressing members being exposed from openings in the sides of the cover member, mounting members at the sides of the shield member having mounting sections disposed in slots in central sections of the latch members. Cantilever members on the latch members along with maintaining sections of the mounting members maintaining the latch members on the mounting members so that the latch members pivot about the mounting sections; and biasing members as part of the rear sections of the latch members engaging the sides of the shield member normally biasing the latch members against the sides of the shield member whereby movement of the pressing members inwardly causes the latch members to move away from the sides of the shield member.

BRIEF DESCRIPTION OF THE DRAWINGS

The invention, together with objects and advantages thereof, is best understood by way of example with reference to the following detailed description in conjunction with the accompanying drawings.

DETAILED DESCRIPTION OF THE INVENTION

Figure 1:
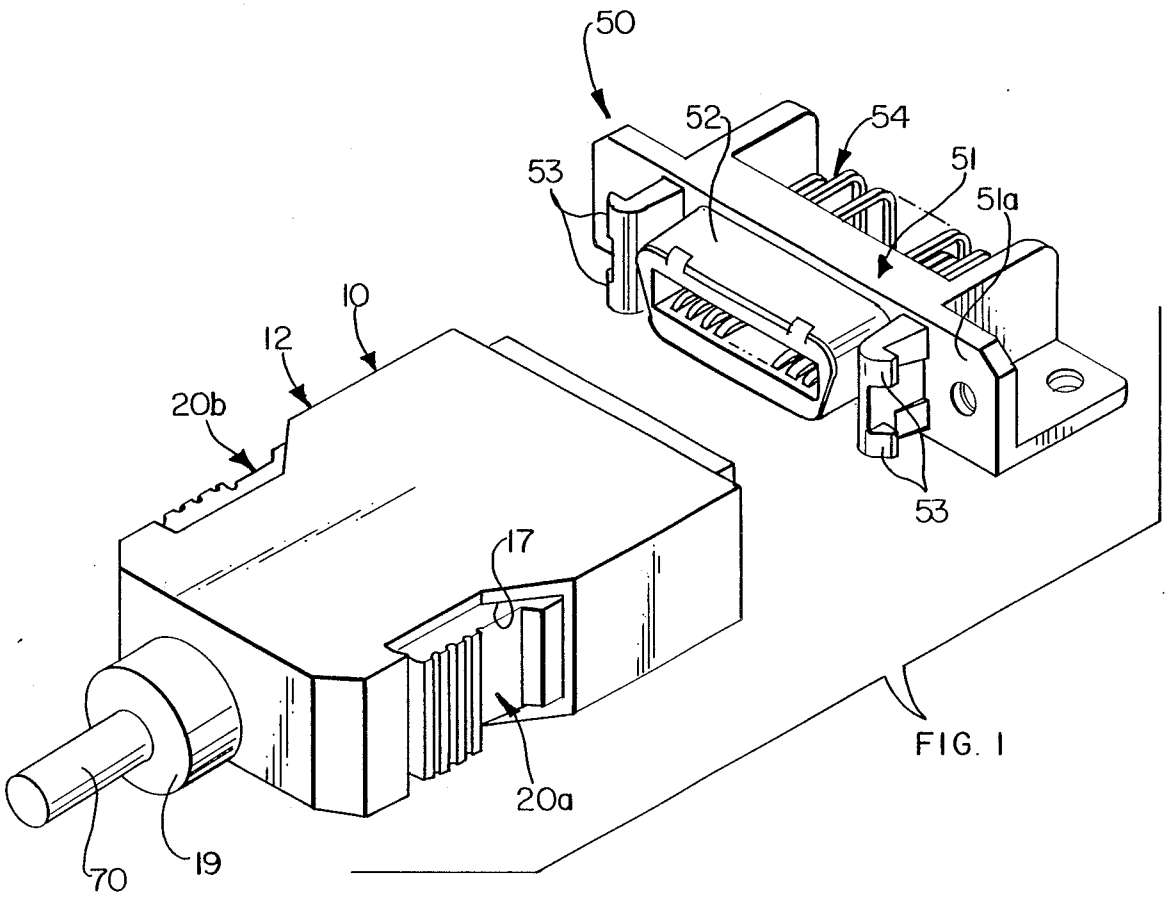
FIG. 1 is a perspective view of a shielded electrical connector connected to a shielded cable exploded from a complementary shielded electrical PCB connector.
Figure 2:
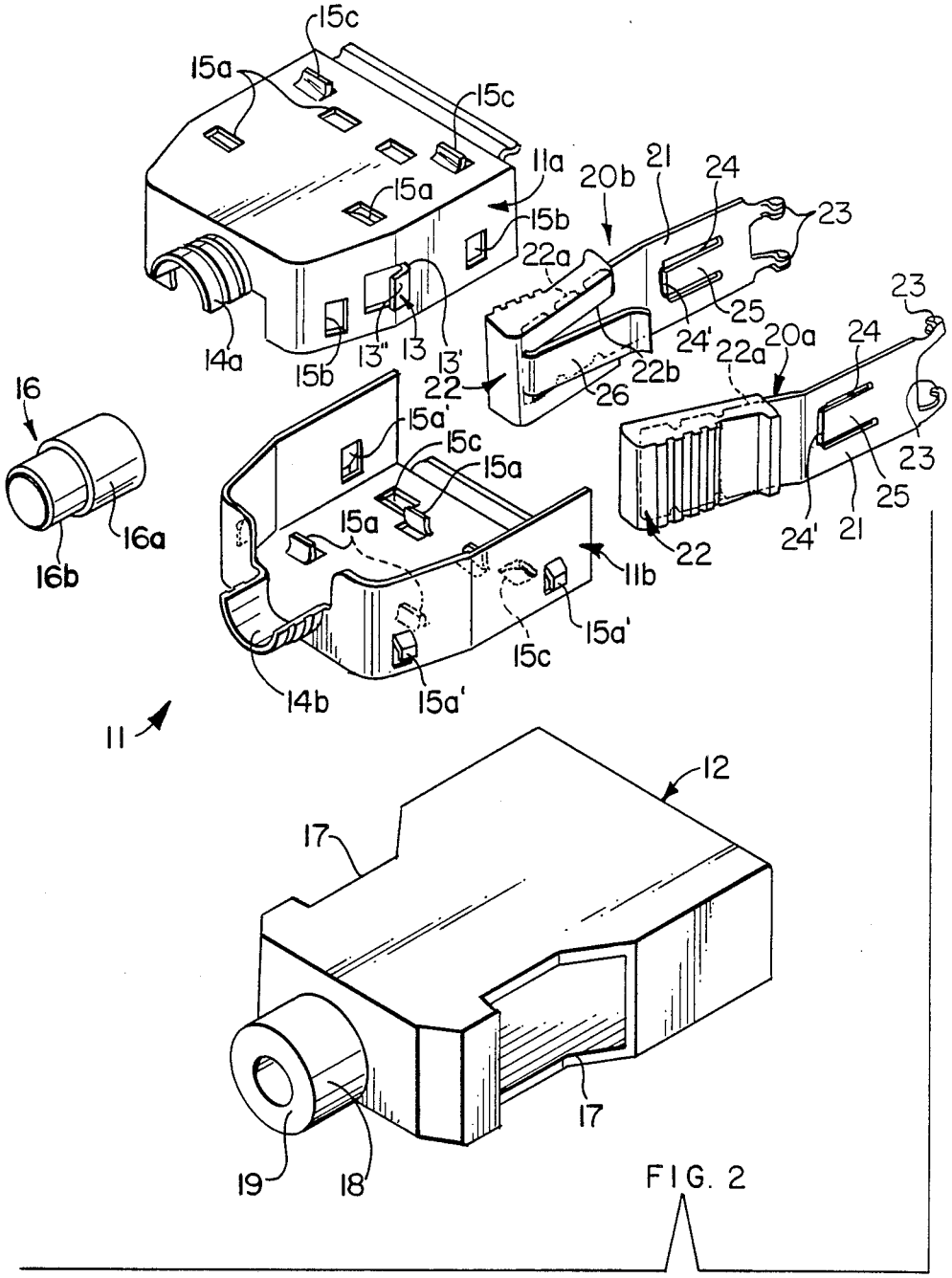
FIG. 2 is an exploded and perspective view of the shield member, latch members and cover member.

As shown in FIGS. 1–7, shielded electrical cable connector 10 is electrically connectable with shielded PCB connector 50. Cable connector 10 includes an electrical contact assembly 27, a metal shield member 11, a dielectric cover member 12 and latch members **20*a*, 20*b***.

Shield member 11 includes upper and lower members **11*a*, 11*b* which are stamped and formed from a suitable metal. The side and rear walls of lower member 11*b* closely fit within the side and rear walls of upper member 11*a***.

Projections **15*a*′ extend outwardly from the side walls of lower member 11*b* and are disposed in rectangular openings 15*b* in the side walls of upper member 11*a* thereby latching members 11*a*, 11*b* together and forming shield member 11 having an open front end. L-shaped mounting members 13 extend outwardly from the side walls of member 11***a* between openings 15*b*.

Figure 6:
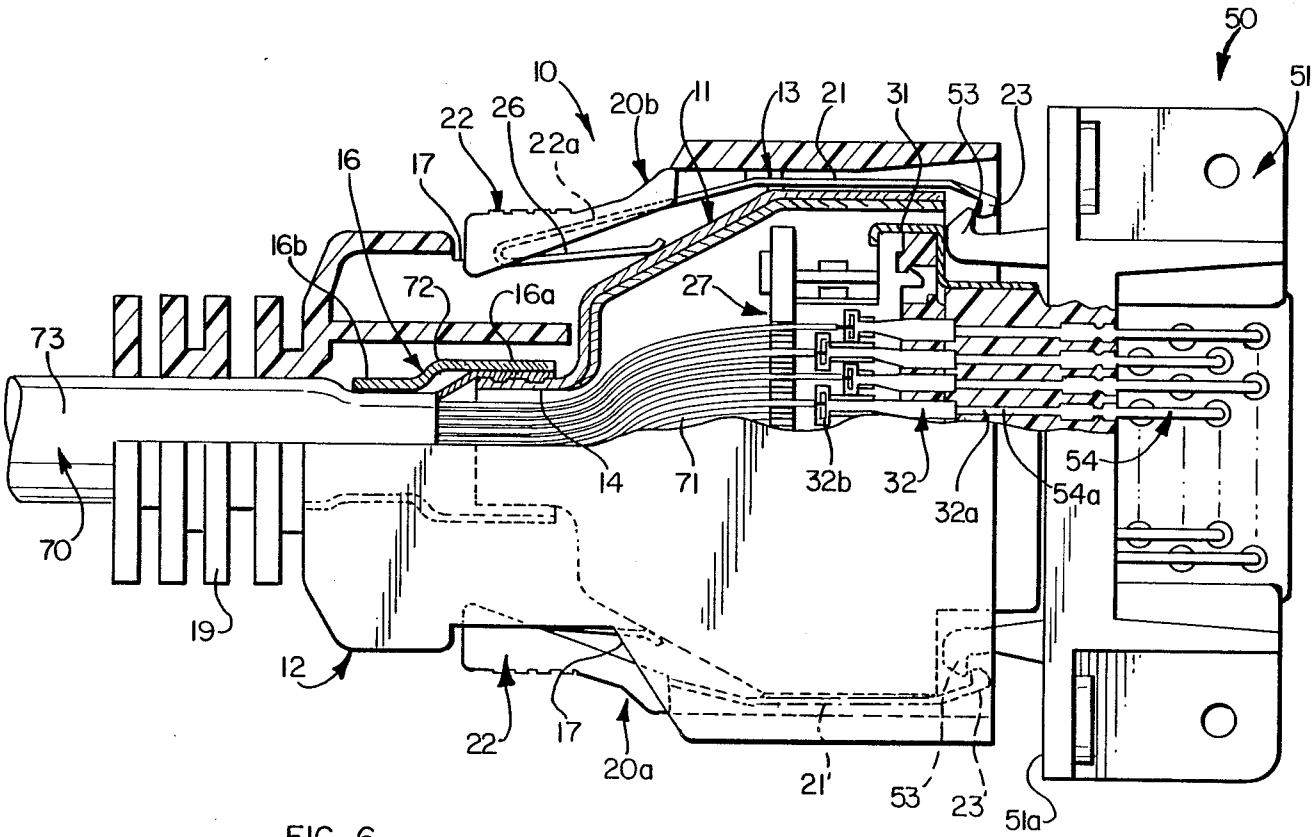
FIG. 6 is a top plan view of FIG. 5 partly in cross section.

The rear walls of members 11*a*, 11*b* have semicircular sections 14*a*, 14*b* which form a cylindrical ferrule 14 through which insulated electrical conductors 71 of shielded electrical cable 70 extend and metal shield 72 of cable 70 is terminated to the outer grooved surfaces of sections 14*a*, 14*b* by the crimping of larger diameter section 16*a* of metal ferrule 16 thereon while smaller diameter section 16*b* is crimped onto outer dielectric jacket 73 of cable 70, as shown in FIG. 6.

Dielectric cover member 12 is molded from a suitable dielectric material that has stiffly-flexible characteristics. Openings 17 are located in the side walls of cover member 12 and the front end is open. An oblong section 19 having grooves 18 therein projects from a rear wall of cover member 12; grooves 18 enabling section 19 to be flexible.

Latch members 20*a*, 20*b* are shown in FIGS. 1–4 and 6 and are made of thin metal plates 21 having spring characteristics and dielectric pressing members 22. Spaced hook members 23 are located at the front ends of plates 21. U-shaped slots 24 are located in plates 21 thereby forming cantilever members 25. Spring members 26 are bent inwardly from the rear ends of plates 21 and the free ends thereof extend toward hook members 23. Pressing members 22 are molded from a suitable dielectric material and have slots 22*a* along which rear sections of plates 21 are press-fitted; the outer surfaces of pressing members 22 being grooved. Openings 22*b* are located in the bottom wall of pressing members 22 so that the spring members 26 can extend outwardly therefrom.

Figure 3:
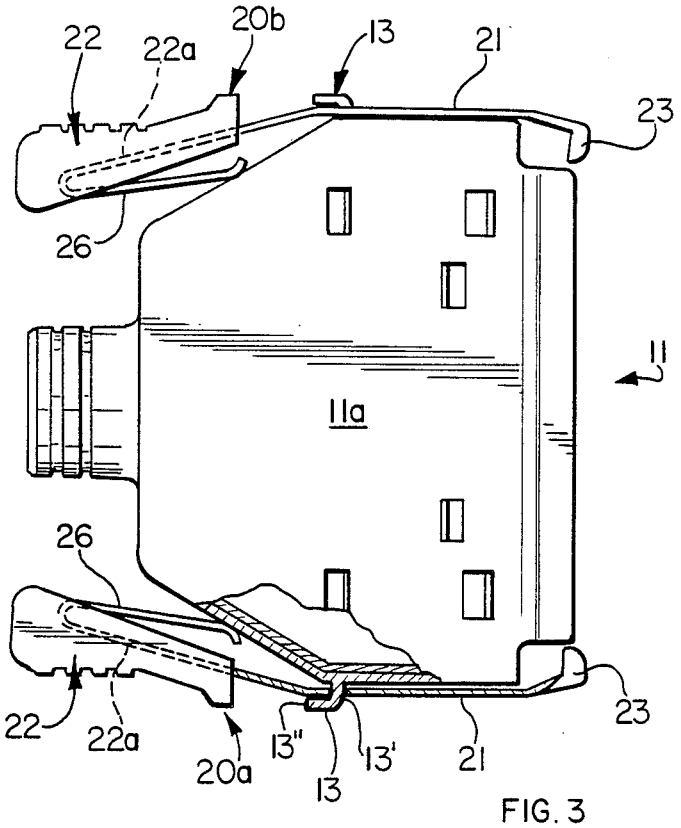
FIG. 3 is a top plan view of the shield member with the latch members mounted thereon.
Figure 4:
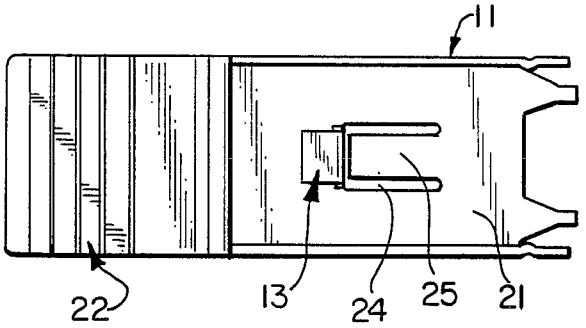
FIG. 4 is a side elevational view of FIG. 3.

Latch members 20*a*, 20*b* are mounted onto L-shaped mounting members 13 of shield member 11 by pressing cantilever members 25 against members 13 causing the cantilever members 25 to move outwardly and members 13 to move through slots 24 whereafter the latch members 20*a*, 20*b* are moved forwardly so that cantilever members 25 move back to their original positions with the short legs 13' of members 13 constituting mounting sections which are disposed in the vertical sections 24' of slots 24, as shown in FIGS. 3 and 4. Thus, latch members 20*a*, 20*b* are hingedly mounted on mounting members 13 of shield member 11 with long legs 13" of members 13 maintaining the latch members 20*a*, 20*b* on members 13 and cantilever members 25 maintain legs 13' within sections 24' of slots 24. This enables latch members 20*a*, 20*b* to be easily mounted onto and to pivot about mounting members 13 when pressing members 22 are moved inwardly against the bias of spring members 26 which engage the sides of shield member 11 so that hook members 23 are moved away from the sides of the shield member 11.

Figure 5:
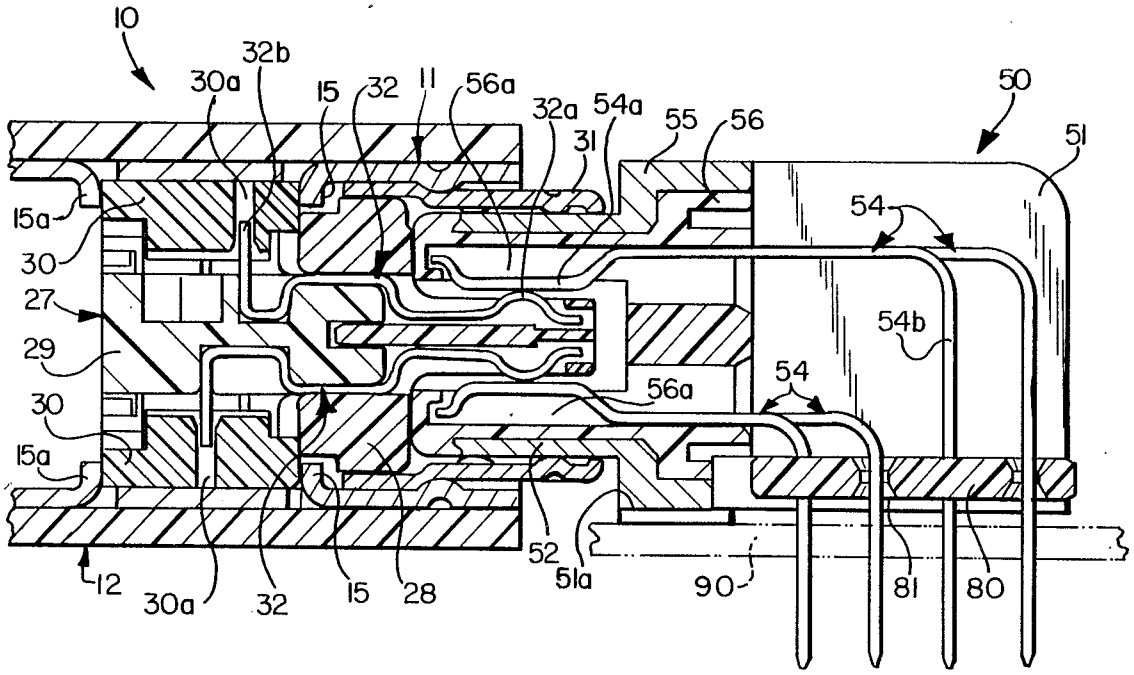
FIG. 5 is a part cross-sectional view of the connectors of FIG. 1 in a mated condition.

Contact assembly 27, shown in FIGS. 5 and 6, includes a front dielectric housing 28, a rear dielectric housing 29 and dielectric cover members 30. Metal shield 31 has a profiled front section that mates with profiled section 52 of connector 50 making electrical connection therewith and a rear section that is secured onto housing 28. Contact sections 32*a* of electrical contacts 32 are disposed in passageways of housing 28 and the front ends of contact sections 32*a* are positioned under flanges at the front ends of the passageways thereby placing them under spring tension. Termination sections 32*b* of contacts 32 are of the known insulation displacement type and are positioned normal to contact sections 32*a* in housing 29 and housings 28, 29 secure contacts 32 in position. Cover members 30 are latchably secured onto the top and bottom of housing 29 and they have slots 30*a* in which the upper ends of termination sections 32*b* are disposed.

Complementary PCB connector 50, as shown in FIGS. 1, 5, 6, 8 and 9, comprises a housing 51 which includes a metal housing 55 and a dielectric housing 56 as part of profiled section 52 which along with hook members 53 extend outwardly from a front surface 51*a* of housing 55.

Figure 7:
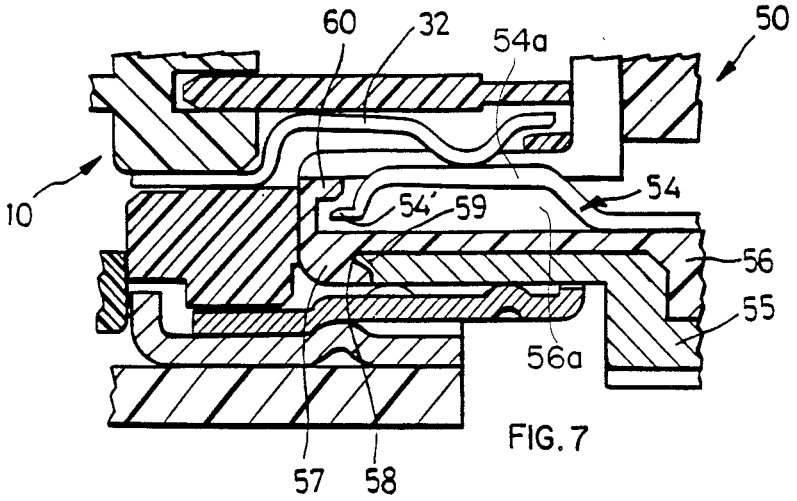
FIG. 7 is an enlarged cross section of a part of FIG. 5.

As can be seen from FIG. 7, a front section 57 of dielectric housing 56 has a tapered recess 58 in which a tapered projection 59 at the front end of metal housing 55 is disposed thereby securing the parts of housings 55, 56 together.

Figure 8:
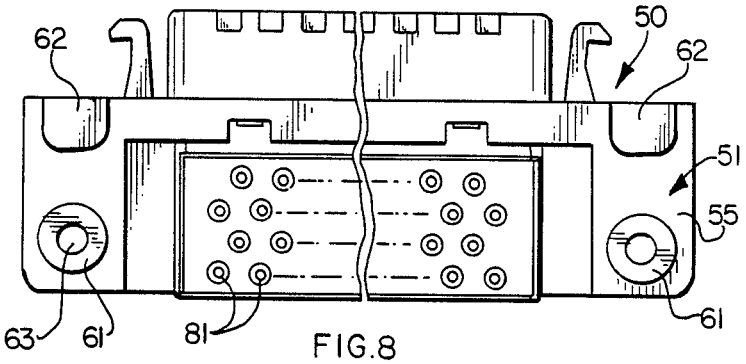
FIG. 8 is a bottom plan view of the PCB connector.
Figure 9:
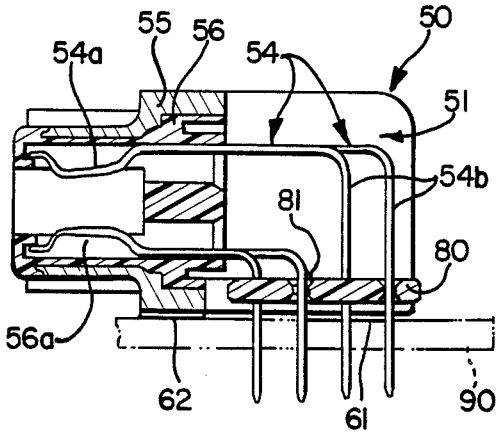
FIG. 9 is a cross-sectional view of FIG. 8.

Electrical contacts 54 have contact sections 54*a* secured in passageways 56*a* of dielectric housing 56 and post sections 54*b* that are normal to contact sections 54*a* which extend through openings 81 of dielectric plate 80 to maintain post sections 54*b* in alignment for disposition in holes of a printed circuit board 90. The front ends 54' of contacts 54 are positioned under a flange 60 at the front end of passageways 56*a* thereby placing contact sections 54*a* under spring tension. As shown in FIGS. 8 and 9, projections 61, 62 are located on the bottom surface of metal housing 55 for engagement with an upper surface of board 90 when connector 50 is mounted thereon so that connector 50 is spaced from such board surface to enable cleaning of the board after soldering post sections 54*b* and other components thereto. Projections 61 surround holes 63 which serve to receive mounting members, such as screws, bolts, or other known members (not shown), to secure connector 50 onto board 90.

Cable 70 has an end stripped exposing insulated conductors 71 and shield 72 (FIG. 6). Cover member 12 and ferrule 16 are positioned on cable 70. Conductors 71 are terminated to respective termination sections 32*b* of contacts 32 by pressing cover members 30 inwardly to their latched positions on housing 29 thereby pressing conductors 71 into the insulation displacement slots of termination sections 32*b*. Contact assembly 27 is then positioned within lower shield member 11*b* with front projections 15*a* of member 11*b* being disposed in a space between the housing 28 and lower cover member 30 and rear projections 15*a* of member 11*b* being positioned adjacent a rear surface of lower cover member 30. Upper shield member 11*a* has latch members 20*a*, 20*b* mounted on mounting members 13 and is latchably mounted on lower member 11*b* via projections 15*a'* in openings 15*b*. Exposed shield 72 is positioned on ferrule section 14 and sections 16*a*, 16*b* of ferrule 16 are crimped onto ferrule section 14 and jacket 73 of cable 70. Cover member 12 is moved along cable 70 covering shield member 11 with pressing members 22 being disposed in openings 17 and hook members 23 being disposed just inside the open front end of cover member 12 (FIG. 6). Projections 15*c* of members 11*a*, 11*b* engage recesses (not shown) on inside surfaces of the upper and bottom walls of cover member 12 to maintain cover member 12 in position on shield member 11.

When connectors 10, 50 are mated together, as shown in FIGS. 5–7, profiled section 52 electrically fits within the profiled front section of shield 31, contact sections 32*a*, 54*a* are electrically engaged and hook members 23, 53 are hooked together thereby maintaining connectors 10, 50 securely latched together. Pressing pressing members 22 inwardly causes latch members 20*a*, 20*b* to pivot about mounting members 13 thereby moving hook members 23 outwardly and free of hook members 53 so that connectors 10, 50 can be disconnected.

The electrical connector of the present invention has latch members that are of simple contsruction which an easy to assemble onto a shield member and which have displayed outstanding stability after many operations thereby assuring accurate latching and unlatching operations.

We claim:

1. A shielded electrical connector for matable and latchable electrical connection with a complementary electrical connector, comprising:

an electrical contact assembly including dielectric housing means having electrical contacts secured in the housing means, the electrical contacts having contact sections;

metal shield means covering said electrical contact assembly and having a profiled mating section for matable engagement with a profiled mating section of the complementary connector;

mounting means on said shield means having mounting section means and maintaining means; and latch members having hook members, pressing members, and, slot means in which said mounting section means is disposed;

and cantilever means on said latch members including said maintaining means of said mounting means maintaining the latch members on said mounting section means so that when the pressing members are moved inwardly, said latch members pivot on said mounting section means causing said hook members to move away from the shield means thereby unlatching said hook members from latching members on the complementary connector.

2. A shielded electrical connector as claimed in claim 1, wherein said mounting section means and said maintaining means of said mounting means have an L-shaped configuration.

3. A shielded electrical connector as claimed in claim 1, wherein said latch members have spring members that engage the shield means normally maintaining the hook members against the shield means.

4. A shielded electrical connector as claimed in claim 1, wherein dielectric cover means covers said shield means and having openings in which said pressing members of said latch members are disposed.

5. A shielded electrical connector as claimed in claim 4, wherein the pressing members are of dielectric material.

6. A shielded electrical connector as claimed in claim 1, wherein the slot means have a U-shape with the cantilever means being located within the U-shaped slot means, a section of said U-shaped slot means adjacent a free end of said cantilever means having the mounting section means of said mounting means disposed therein.

* * * * *